US007464820B2

(12) United States Patent
Oh

(10) Patent No.: US 7,464,820 B2
(45) Date of Patent: Dec. 16, 2008

(54) COMPACT COSMETIC CASE WITH AIRTIGHT SEALED STRUCTURE

(76) Inventor: Jin Se Oh, 102-207 Gumseong 5th Apartment, 1211-1, Maetan-dong, Paldai-gu, Suwon 442-370 (KR)

( * ) Notice: Subject to any disclaimer, the term of this patent is extended or adjusted under 35 U.S.C. 154(b) by 158 days.

(21) Appl. No.: 11/349,710

(22) Filed: Feb. 8, 2006

(65) Prior Publication Data

US 2006/0151355 A1 Jul. 13, 2006

Related U.S. Application Data

(63) Continuation of application No. PCT/KR03/02312, filed on Oct. 30, 2003.

(30) Foreign Application Priority Data

Aug. 11, 2003 (KR) ..... 20-2003-0025865 U
Oct. 1, 2003 (KR) ..... 20-2003-0031004 U

(51) Int. Cl.
*B65D 69/00* (2006.01)

(52) U.S. Cl. ..... 206/581; 132/293

(58) Field of Classification Search ..... 206/581, 206/235, 823; 220/378, 217, 228, 849, 806; 132/293–307
See application file for complete search history.

(56) References Cited

U.S. PATENT DOCUMENTS 3,900,130 A * 8/1975 Andrews ..... 220/378
4,310,748 A * 1/1982 Paulin ..... 219/437
5,361,928 A * 11/1994 Stolzman ..... 220/378
5,909,738 A * 6/1999 Quennessen ..... 132/293
5,950,639 A * 9/1999 Suzuki et al. ..... 132/294
6,076,679 A * 6/2000 Yuhara et al. ..... 206/581
6,336,460 B2 * 1/2002 Yuhara ..... 132/295
2007/0029226 A1 * 2/2007 Yuhara et al. ..... 206/581

FOREIGN PATENT DOCUMENTS

JP 60-73405 U 5/1985
JP 9-037838 2/1997
KR 20-0227236 6/2001
KR 20-0246733 12/2001

OTHER PUBLICATIONS

International Search Report, May 11, 2004 (1 page).

* cited by examiner

*Primary Examiner*—J. Gregory Pickett
(74) *Attorney, Agent, or Firm*—Tuchman & Park LLC

(57) ABSTRACT

Compact cosmetic case with airtight sealed structure, which has a simple construction and enhances its airtight sealed effect to prevent a leakage of cosmetics, such as powder, thus improving quality, increasing productivity and reducing the production costs. The compact cosmetic case includes a body, an inner casing to contain the powder, an inner lid hinged the inner casing and having a powder puff seat, and an outer lid hinged to the body and having a locking part. A groove is formed around an upper surface of the inner casing, with liquid rubber filling the groove to form a rubber seal. A locking hole is formed on the inner casing, while a locking lever having a locking projection is formed on the inner lid to be locked to the locking hole.

12 Claims, 13 Drawing Sheets

COMPACT COSMETIC CASE WITH AIRTIGHT SEALED STRUCTURE

CROSS-REFERENCE TO RELATED APPLICATIONS

This application is a continuation of international patent application PCT/KR2003/002312 filed on Oct. 30, 2003 and published in English language as WO 2005/013758 A1, which international application claims priority under the Paris convention from Korean patent applications 20-2003-0031004 filed Oct. 1, 2003 and 20-2003-0025865 filed on Aug. 11, 2003.

FIELD OF THE INVENTION

The present invention relates, in general, to compact cosmetic cases which contain colored cosmetics for a long period of time and maintain moisture levels and scents of the cosmetics during the life time of the compacts and, more particularly, to a compact cosmetic case with an airtight sealed structure, which has a simple construction and enhances its airtight sealing effect to prevent a leakage of cosmetics, such as powder, thus improving quality, increasing productivity and reducing the production costs thereof.

BACKGROUND OF THE INVENTION

Generally, colored cosmetics are contained in portable cosmetic cases. As an example, a compact comprises a case which has a predetermined shape and contains a solid foundation therein. When a user desires to use the compact, the user applies powder of the solid foundation on his/her face using a powder puff which is provided in the cosmetic case.

However, the above-mentioned solid foundation includes a volatile solvent. If the cosmetic case is not an airtight sealed structure, the volatile solvent gradually evaporates into the atmosphere, so that the foundation may harden.

In addition, such the portable cosmetic case is disadvantageous in that a characteristic of the colored cosmetic contained in the cosmetic case is not secured, because a specific scent of the cosmetic may evaporate into the atmosphere.

In an effort to overcome the problems experienced in the conventional cosmetic cases, compact cosmetic cases with airtight sealed structures have been proposed. However, the conventional compact cosmetic case is problematic in that its structure is complex, and its production costs increase.

FIG. 1 is a sectional view of the conventional compact cosmetic case with the airtight sealed structure. FIG. 2 is a partially enlarged view of the conventional compact cosmetic case shown by enlarging a portion A of the compact cosmetic case of FIG. 1.

As shown in FIGS. 1 and 2, the conventional compact cosmetic case with the airtight sealed structure includes a body 1 having an inner casing 2 therein to define a containing space 3 which contains a cosmetic C.M therein. The conventional compact cosmetic case further includes an inner lid 4 which is hinged to the inner casing 2 and has a powder puff seat 5. The inner lid 4 is made of a transparent resin. The conventional compact cosmetic case further includes an outer lid 6 to define a cover of the body 1. The outer lid 6 is hinged to the body 1 at a first side thereof, and a locking unit is provided on the compact cosmetic case at a position around a second side of the outer lid 6 diametrically opposite to the first side so as to lock and unlock the outer lid 6 to and from the body 1, so that the body 1 is open and closed by the outer lid 6.

At this time, to maintain the moisture level and scent of the cosmetic C.M which is contained in the containing space 3 of the body 1, an annular gap 7 is formed between an outside edge of the top of the inner casing 2 and an inside edge of the top of a spacing frame 8 which is provided around the top of the inner casing 2. A rubber gasket 9, which is made of elastic rubber and has a ring shape, is provided in the annular gap 7. A support frame 10 is provided between an inside surface of the spacing frame 8, an outside surface of the inner casing 2 and a lower surface of the rubber seal 9, so that the inner casing 2, the spacing frame 8 and the rubber seal 9 are fabricated to be supported together by the support frame 10. The outer lid 6 has an outer tip 11 on a lower surface thereof around a circle to compress an upper surface of the rubber gasket 9, thus airtightly sealing the containing space 3 of the inner casing 2 from the outside.

To fabricate the airtight sealed structure to accomplish the sealing effect of the inner casing 2 from the outside in the conventional compact cosmetic case, the rubber gasket 9, the spacing frame 8 and the support frame 10 are separately formed and assembled in the body 1 to support the rubber gasket 9 in the body 1. Therefore, the conventional compact cosmetic case is disadvantage in that the consumption of the material of the case is increased, and the manufacturing process is complex, thus increasing the production costs.

SUMMARY OF THE INVENTION

Accordingly, the present invention has been made keeping in mind the above problems occurring in the prior art, and an object of the present invention is to provide a compact cosmetic case with an airtight sealed structure, which increases its sealing effect despite of a simple construction, thus enhancing the quality thereof.

Another object of the present invention is to provide a compact cosmetic case with an airtight sealed structure, which reduces the production costs by simplifying its manufacturing process in that liquid rubber fills and is vulcanized in an inner casing of the compact cosmetic case without separately forming a gasket, different from conventional compact cosmetic cases, thus accomplishing a desired sealing effect of the inner casing from the outside.

A further object of the present invention is to provide a compact cosmetic case with an airtight sealed structure, which enhances its sealing effect while an inner tip formed around an outside surface of an inner lid is in contact with an airtight rubber seal formed in a groove of the inner casing, without having any additional outer projection which is formed on an outer lid to compress an upper surface of the inner lid.

Still another object of the present invention is to provide a compact cosmetic case with an airtight sealed structure, which prevents powder applied in a powder puff contained in the compact cosmetic case from leaking through a gap between an upper surface of a body of the compact cosmetic case and a lower surface of the outer lid hinged to the body, so as to accomplish cleanliness of the compact cosmetic case, thus improving the quality of the case.

In order to accomplish the above object, the present invention provides a compact cosmetic case, including a body having an inner casing therein to define a containing space which contains a cosmetic therein, an inner lid hinged to the inner casing and having a powder puff seat. The inner lid is made of a transparent resin. The compact cosmetic ease further includes an outer lid to define a cover of the body. The outer lid is hinged to the body at a first side thereof. The compact cosmetic case further includes a locking unit which is provided on the case at a position around a second side of the outer lid diametrically opposite to the first side so as to lock and unlock the outer lid to and from the body, so that the body is open and closed by the outer lid. The compact cosmetic case further includes an inner groove formed around an upper surface of the inner casing, with liquid rubber filling the inner groove and being vulcanized in the inner groove to form a first airtight rubber seal. The compact cosmetic case further includes an inner tip formed around an outside surface of the inner lid to be in contact with the first airtight rubber seal.

The compact cosmetic case may further include an outer projection formed on a lower surface of the outer lid to compress an upper surface of the inner lid.

The compact cosmetic case may further include a locking hole formed on the inner casing at a position corresponding to the second side of the outer lid diametrically opposite to the first side at which the outer lid is hinged to the body, and a locking lever having a locking projection and formed on the inner lid to be locked to the locking hole.

The compact cosmetic case may further include an outer groove formed around an upper surface of the body, with silicon rubber filling the outer groove and being vulcanized in the outer groove to form a second airtight rubber seal, and an outer tip formed around a lower surface of the outer lid to be in contact with the second airtight rubber seal.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
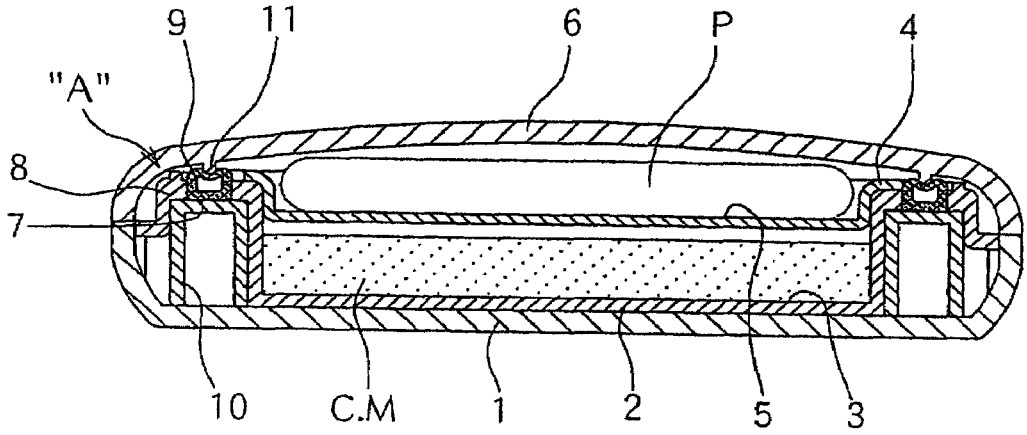
FIG. 1 PRIOR ART
FIG. 1 is a sectional view of a conventional compact cosmetic case with an airtight sealed structure.
Figure 2:
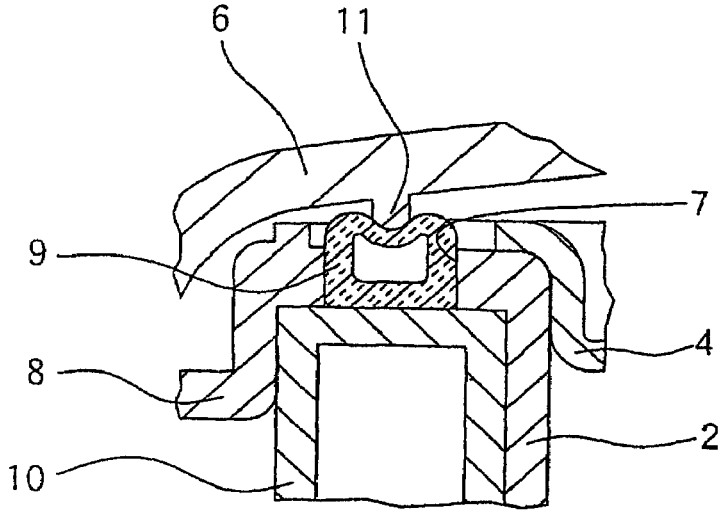
FIG. 2 PRIOR ART
FIG. 2 is a partially enlarged view of the compact cosmetic case shown by enlarging a portion A of the compact cosmetic case of FIG. 1.
Figure 3:
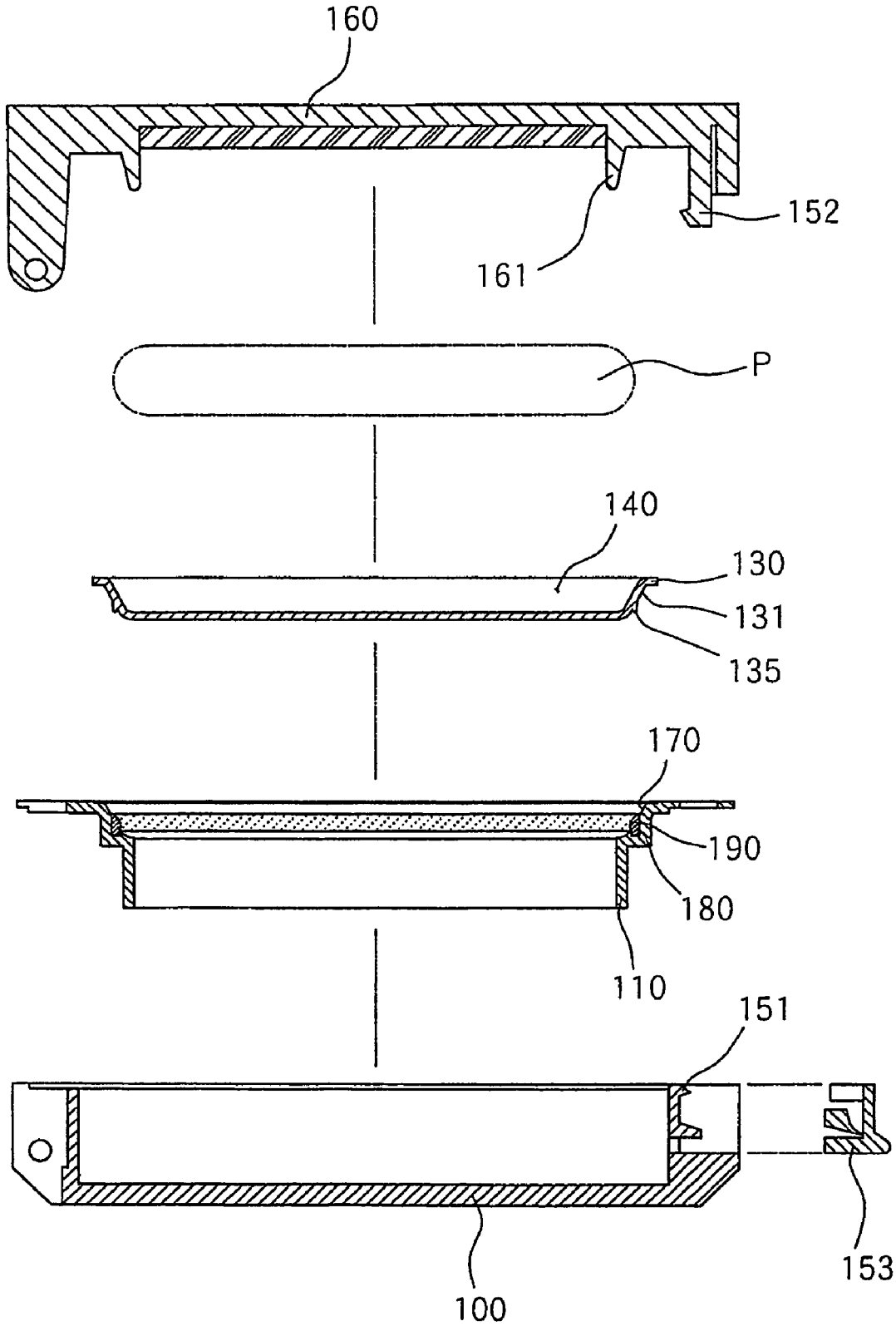
FIG. 3 is an exploded sectional view of a compact cosmetic case with an airtight sealed structure, according to a first embodiment of the present invention.
Figure 4:
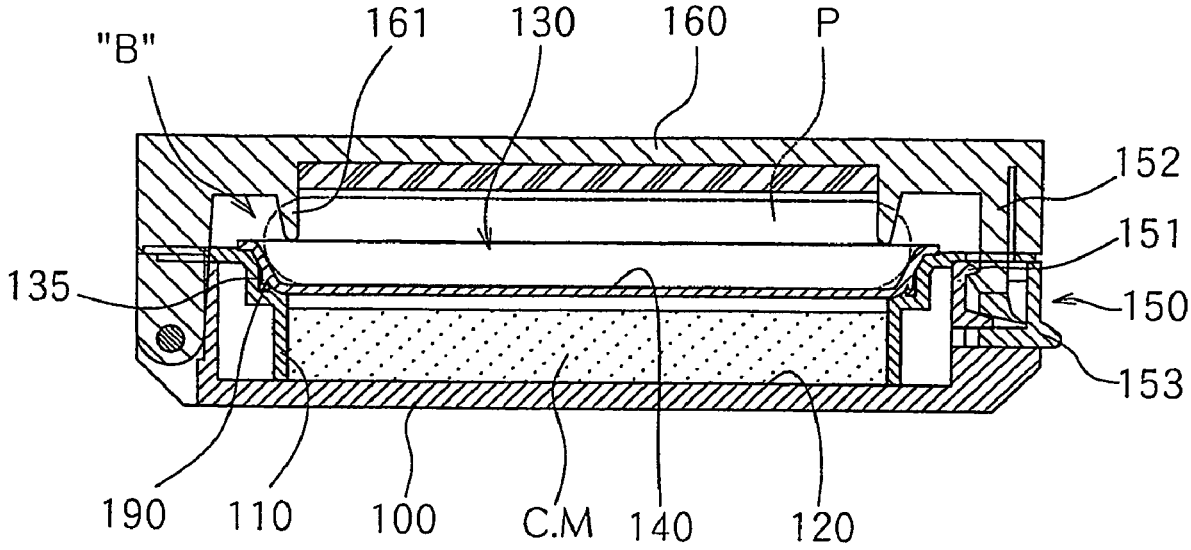
FIG. 4 is a sectional view showing the compact cosmetic case of FIG. 3, in which an outer lid closes a body.
Figure 5:
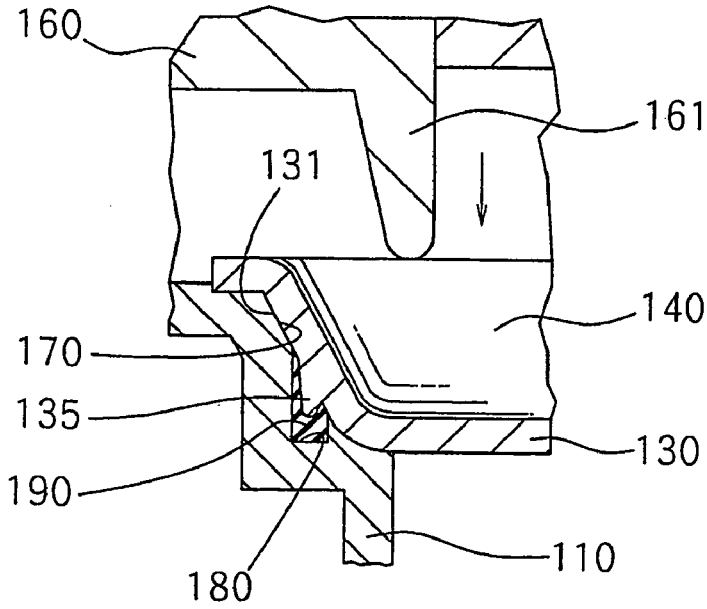
FIG. 5 is a partially enlarged view of the compact cosmetic case shown by enlarging a portion B of the compact cosmetic case of FIG. 4.

Reference should now be made to the drawings, in which the same reference numerals are used throughout the different drawings to designate the same or similar components.

FIGS. 3 to 7 are views showing a compact cosmetic case with an airtight sealed structure, according to a first embodiment of the present invention.

As shown in FIGS. 3 to 7, the compact cosmetic case of the first embodiment of the present invention includes a body 100 having an inner casing 110 therein to define a containing space 120 which contains a cosmetic C.M therein. The compact cosmetic case further includes an inner lid 130 which is hinged to the inner casing 110 and has a powder puff seat 140. The inner lid 130 is made of a transparent resin. The compact cosmetic case further includes an outer lid 160 to define a cover of the body 100. The outer lid 160 is hinged to the body 100 at a first side thereof, and a locking unit 150 is provided on the compact cosmetic case at a position around a second side of the outer lid 160 diametrically opposite to the first side so as to lock and unlock the outer lid 160 to and from the body 100, so that the body 100 is open and closed by the outer lid 160.

The compact cosmetic case further includes an inner groove 180 which is formed around an upper surface 170 of the inner casing 110, with liquid rubber filling the inner groove 180 and being vulcanized in the inner groove 180 to form a first airtight rubber seal 190.

In the compact cosmetic case of the first embodiment of the present invention, an outside surface 131 of the inner lid 130 hinged to the inner casing 110 is in contact with both the upper surface 170 and the first airtight rubber seal 190 of the inner casing 110, so that the compact cosmetic case accomplishes an airtight sealing effect of the inner casing 110 from the outside by the first airtight rubber seal 190 of the upper surface 170 of the inner casing 110, thus maintaining moisture level and scent of the cosmetic C.M in the containing space 120 of the inner casing 110 for a lengthy period.

When the outside surface 131 of the inner lid 130 is in contact with the first airtight rubber seal 190 of the upper surface 170 of the inner casing 110, the compact cosmetic case of the present invention accomplishes the airtight sealing effect of the inner casing 110 from the outside by the weight of the powder puff P in the power puff seat 140 of the inner lid 130, and by the outer lid 160 to compress an upper surface of the powder puff P.

As shown in the accompanying drawings of the present invention, to preferably accomplish the airtight sealing effect of the inner casing 110, an inner tip 135 is formed around the outside surface 131 of the inner lid 130 to correspond to the first airtight rubber seal 190 filling the inner groove 180 of the upper surface 170 of the inner casing 110, so that the inner tip 135 of the inner lid 130 compresses an upper surface of the first airtight rubber seal 190.

In the compact cosmetic case of the present invention having the abovementioned construction, the moisture level and scent of the cosmetic C.M contained in the containing space 120 of the inner casing 110 are maintained without being changed for a long period because the inner tip 135 of the inner lid 130 compresses the upper surface of the first airtight rubber seal 190.

In addition, an outer projection 161 is formed on a lower surface of the outer lid 160 along a circle to compress an upper surface of the inner lid 130. Therefore, when the outer lid 160 completely closes the body 100 of the compact cosmetic case, the inner tip 135 of the inner lid 130 further compresses the upper surface of the first airtight rubber seal 190, thus reliably accomplishing the airtight sealing effect of the containing space 120 of the inner casing 11 from the outside.

Preferably, the inside edge of the upper surface 170 of the inner casing 110 and the outer surface 131 of the inner lid 130 corresponding to the inside edge of the upper surface 170 are inclined inward and downward to be easily in contact with each other.

In the meantime, the outer projection 161 of the outer lid 160 may comprise a plurality of projections which are formed on the lower surface of the outer lid 160 at regular intervals along the circle aligned with the inside of the edge of the upper surface of the inner lid 130, or a ring-shaped projection which is formed on the lower surface of the outer lid 160 along the circle aligned with the inside of the edge of the upper surface of the inner lid 130.

The locking unit 150 includes a stopper 151 which is provided at a predetermined portion of the body 100 corresponding to the second side of the outer lid 160. The locking unit 150 further includes an elastic hook 152 which is formed on the second side of the outer lid 160 at a position corresponding to the stopper 151 to be elastically locked by the stopper 151, and a release button 153 which pushes a side surface of the elastic hook 152 to unlock the elastic hook 152 from the stopper 151 when a user pushes the release button 153.

Figure 6:
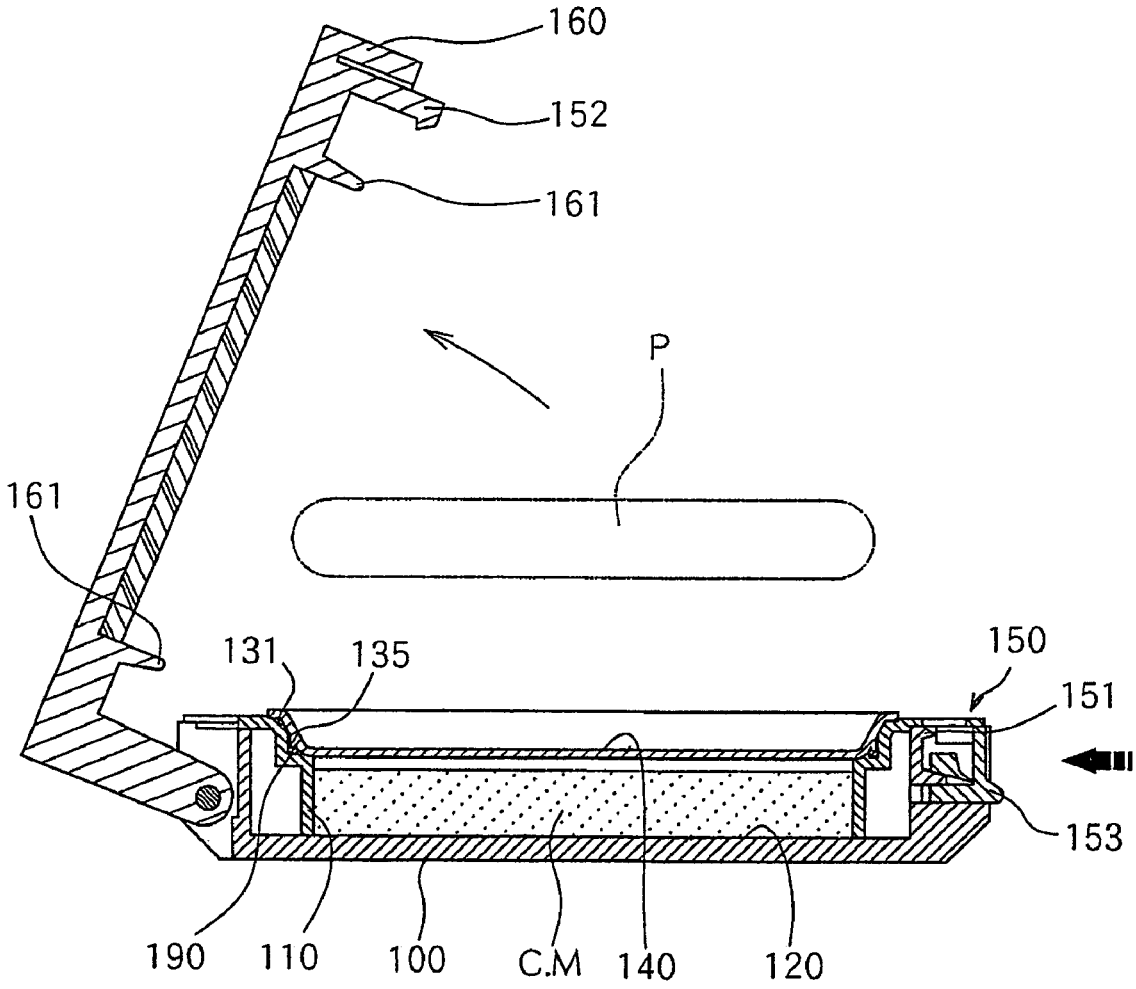
FIG. 6 is a sectional view of the compact cosmetic case of FIG. 3, in which the outer lid opens the body.
Figure 7:
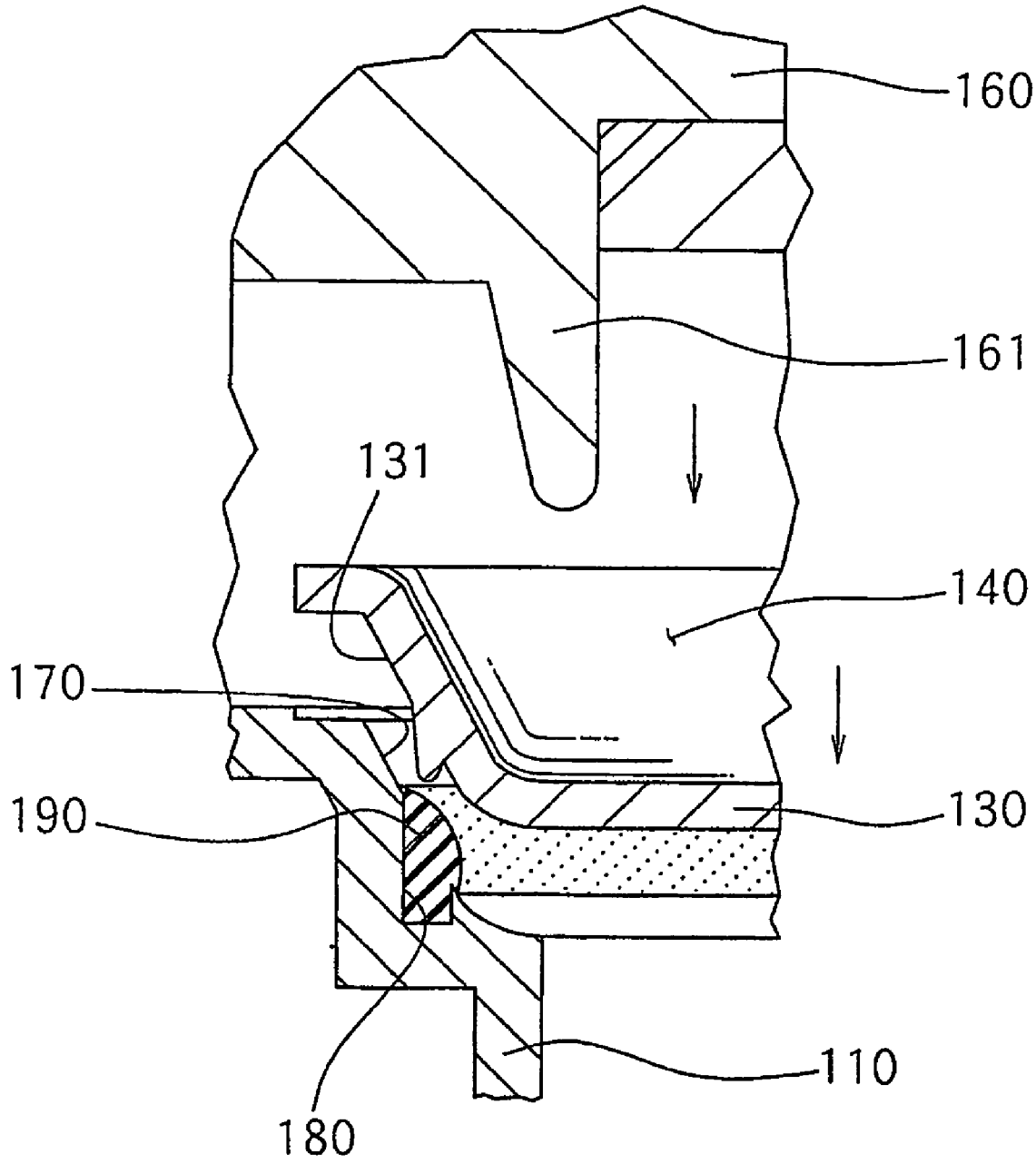
FIG. 7 is a partially enlarged view of the compact cosmetic case shown by enlarging a part of the compact cosmetic case of FIG. 6 while the outer lid closes the body.
Figure 8:
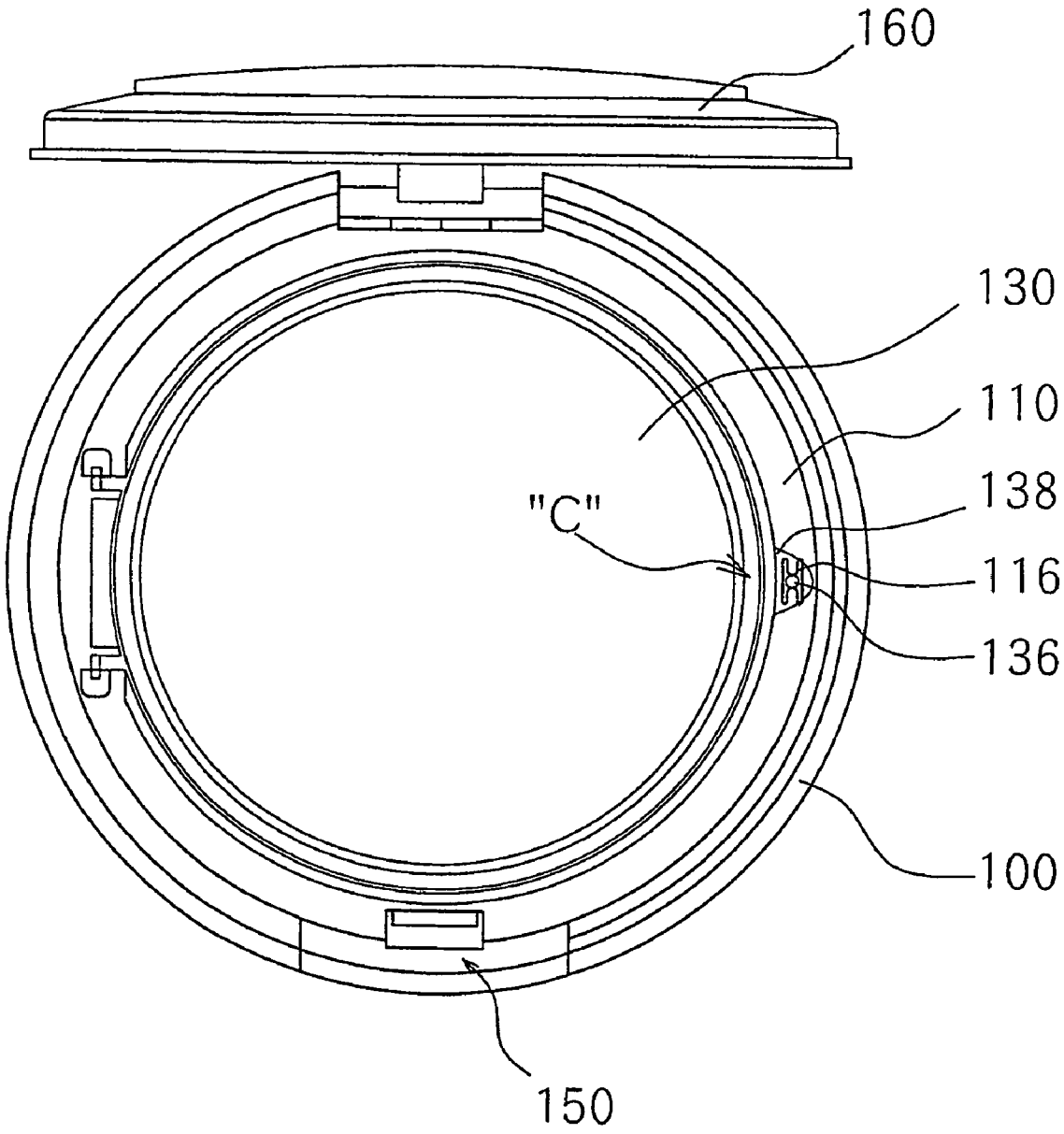
FIG. 8 is a top view of a compact cosmetic case with an airtight sealed structure, in which the outer lid opens the body of the compact cosmetic case, according to a second embodiment of the present invention.
Figure 9:
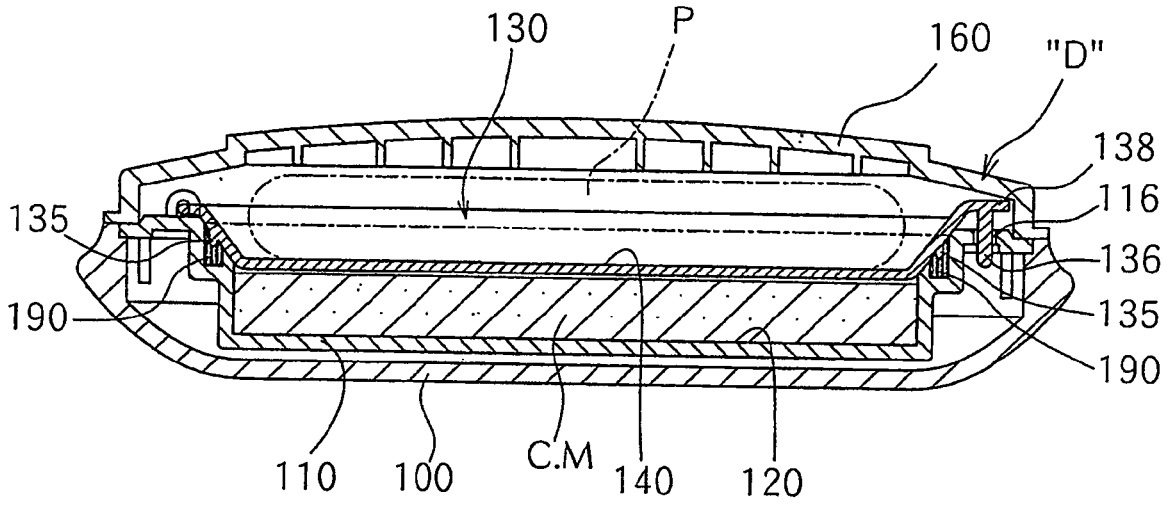
FIG. 9 is a sectional view showing the compact cosmetic case of the second embodiment of the present invention, in which the outer lid closes the body.
Figure 10:
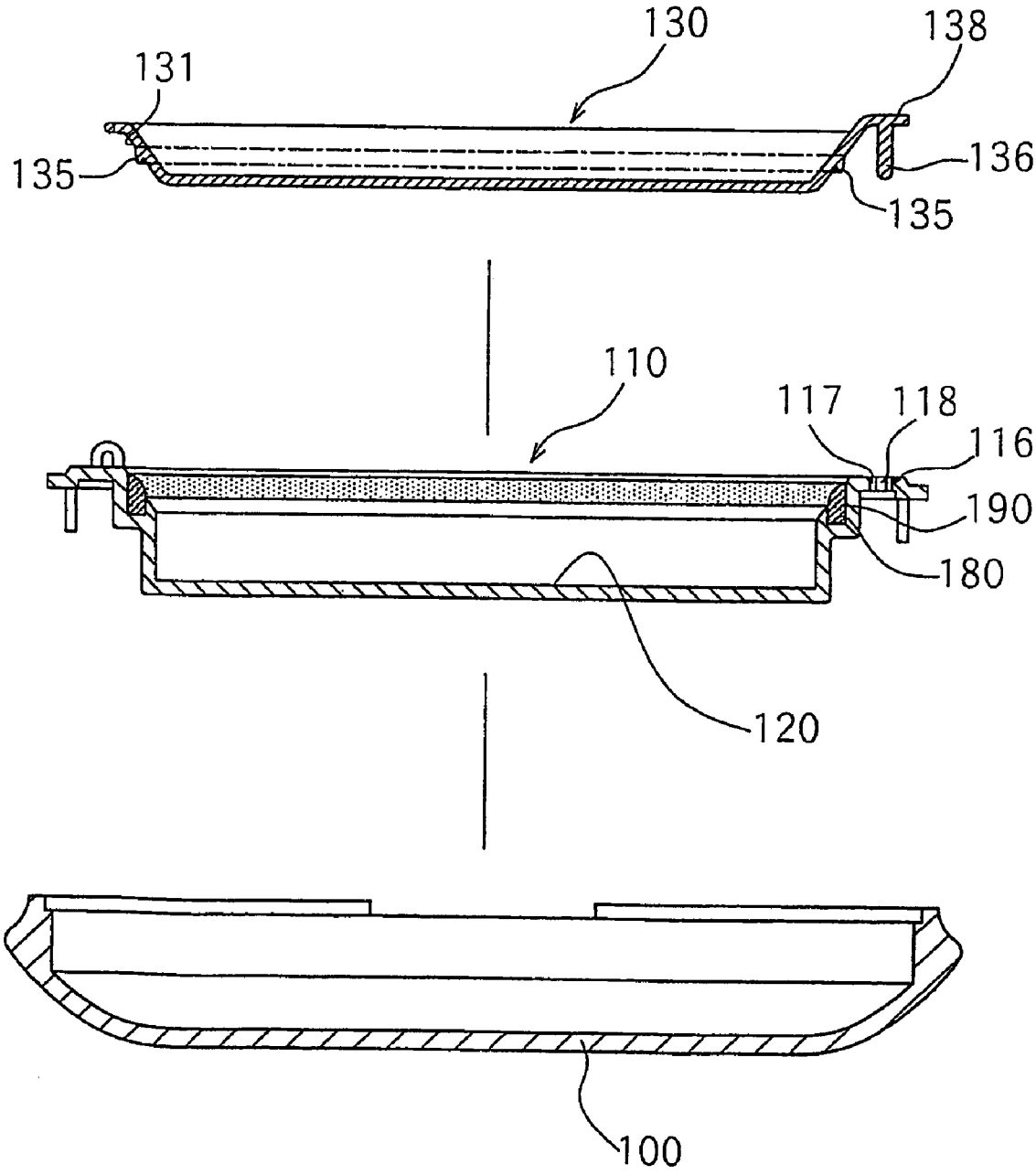
FIG. 10 is an exploded sectional view showing parts of the compact cosmetic case of the FIG. 9, in which the outer lid is not shown.
Figure 11:
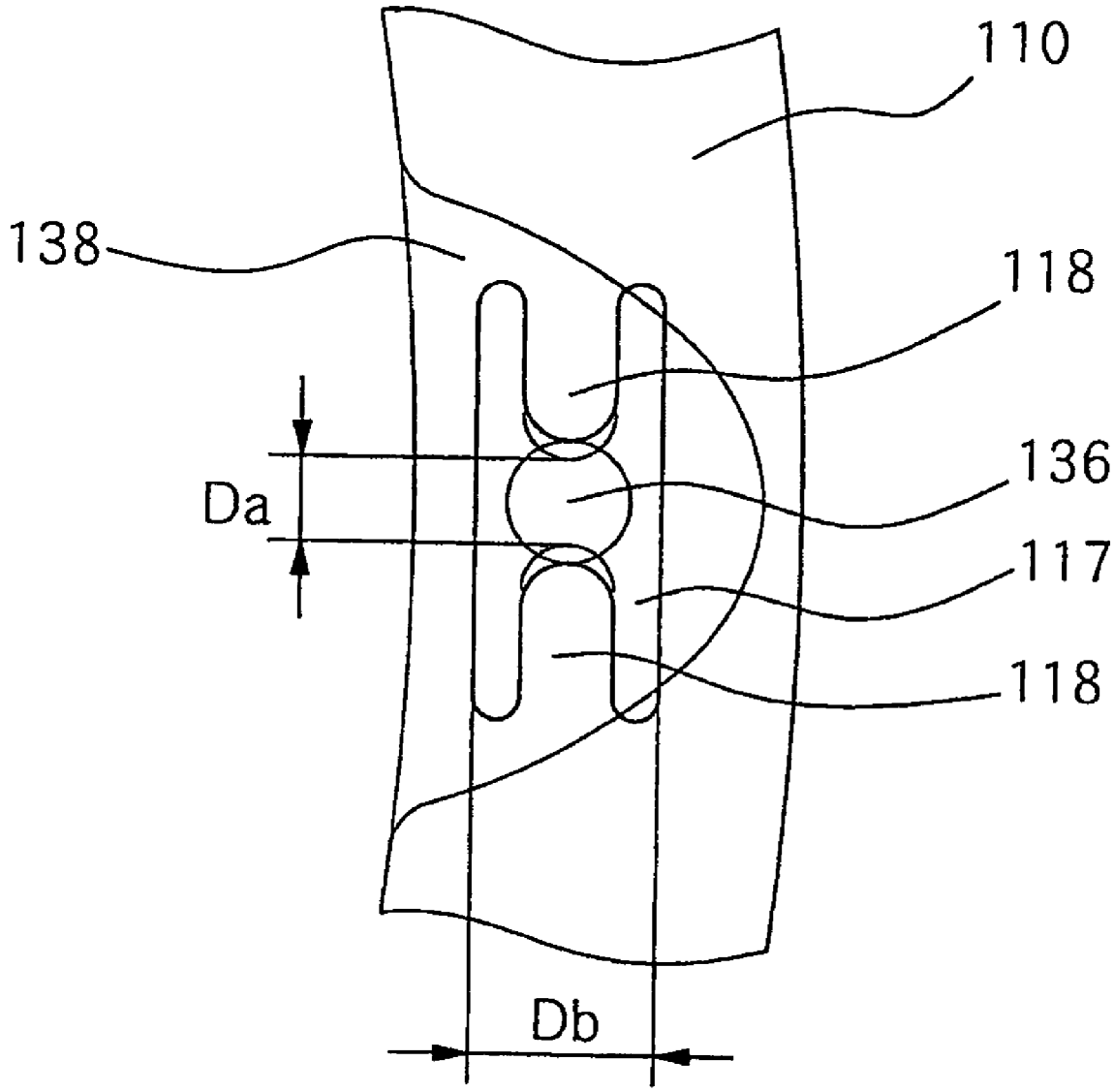
FIG. 11 is a partially enlarged view of the compact cosmetic case shown by enlarging a portion C of the compact cosmetic case of FIG. 8.

When the user desires to use the cosmetic C.M of the compact cosmetic case, the body 100 is open, as shown in FIG. 6. That is, the elastic hook 152 of the locking unit 150 is unlocked from the stopper 151 of the locking unit 150 when the user pushes the release button 153 of the locking unit 150. Thereafter, the user opens the outer lid 160 hinged to the body 100, and picks up the powder puff P placed in the powder puff seat 140 of the inner lid 130. The user, thereafter, opens the inner lid 130 hinged to the inner casing 110 to apply the cosmetic C.M, contained in the containing space 120 of the inner casing 110, on his/her face by using the powder puff P.

When finishing use of the cosmetic C.M of the compact cosmetic case, the user closes the inner lid 130 and places the powder puff P in the powder puff seat 140 of the inner lid 130. Thereafter, the user pushes the outer lid 160 onto the body 100 so that the outer lid 160 is locked to the body 100 by an operation of the locking unit 150.

FIGS. 8 to 13 are views showing a compact cosmetic case with an airtight sealed structure, according to the second embodiment of the present invention.

As shown in FIGS. 8 to 13, the compact cosmetic case of the second embodiment of the present invention includes a locking hole 116 which is formed on the inner casing 110 at a position corresponding to the second side of the outer lid 160 opposite to the first side at which the outer lid 160 is hinged to the body 100, and a locking lever 138 which is formed on the inner lid 136 and has a locking projection 136 to be locked to the locking hole 116 of the inner casing 110, different from the compact cosmetic case of the first embodiment of the present invention.

The locking hole 116 of the inner casing 110 has a locking opening 117, with a pair of elastic projections 118 which are projected inwardly from centers of both sides of the locking opening 117 to form an H-shaped appearance of the locking opening 117.

At this time, the locking projection 136 of the locking lever 138 of the inner lid 130 has a diameter larger than a gap Da between the pair of the elastic projections 118 of the locking hole 116 of the inner casing 110 and smaller than a width Db between opposite edges of the H-shaped locking opening 117 of the locking hole 116.

Figure 13:
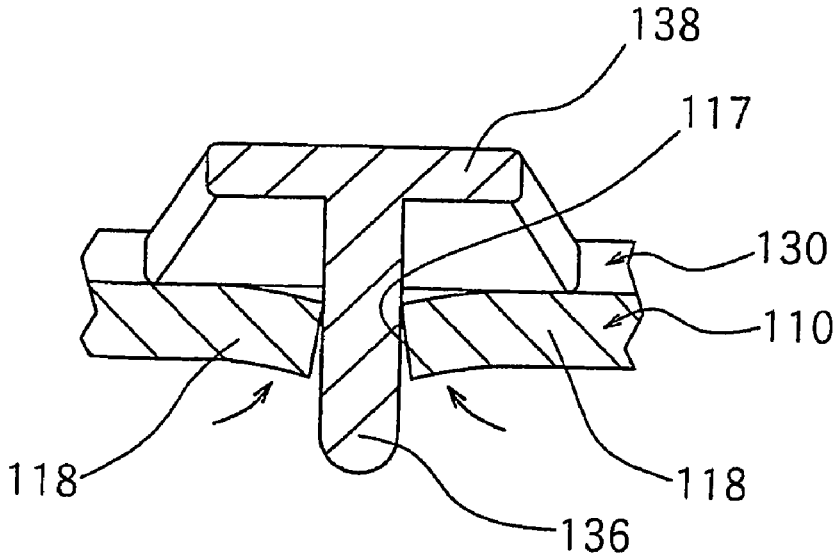
FIG. 13 is an exploded sectional view taken along the line IV-IV of FIG. 12.

As shown in FIG. 13, when the locking projection 136 of the locking lever 138 is downward inserted into the gap Da between the elastic projections 118 of the locking hole 116 of the inner casing 110, the ends of the elastic projections 118 are slightly downward bent to compress and frictionally hold the locking projection 136, so that the locking projection 136 is locked between the elastic projections 118. Therefore, the inner tip 135 of the outside surface 131 of the inner lid 130 compresses the upper surface of the first airtight rubber seal 190 of the upper surface 170 of the inner casing 110 while the outside surface 131 of the inner lid 130 is in contact with the upper surface 170 of the inner casing 110, thus maintaining the moisture level and scent of the cosmetic C.M contained in the containing space 120 of the inner casing 110, for a lengthy period.

Figure 12:
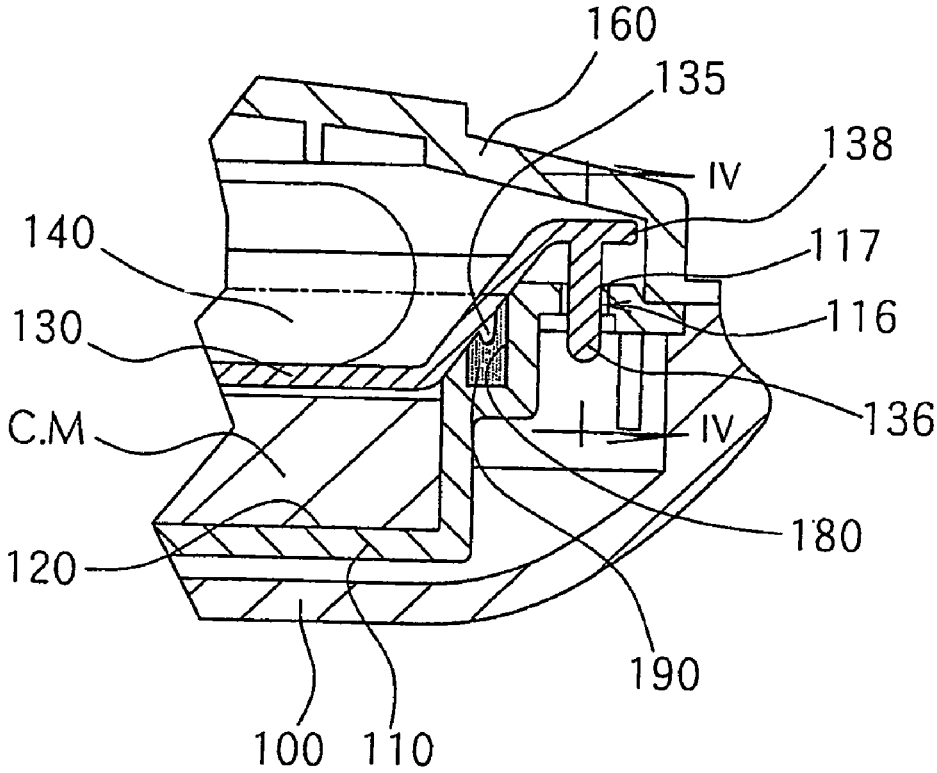
FIG. 12 is a partially enlarged sectional view of the compact cosmetic case shown by enlarging a portion D of the compact cosmetic case of FIG. 9.
Figure 14:
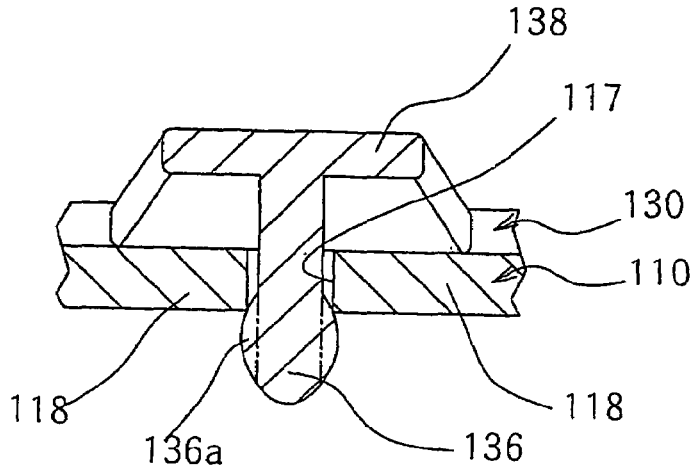
FIG. 14 is a view corresponding to FIG. 13, but showing a third embodiment of the present invention.

FIG. 14 is an exploded sectional view taken along the line IV-IV of FIG. 12, according to a third embodiment of the present invention.

As shown in FIG. 14, the locking projection 136 of the locking lever 138 of the inner lid 130 may have a diameter smaller than the gap Da between the pair of elastic projections 118 of the locking hole 116 of the inner casing 110, with a locking boss **136*a* integrally formed around an end of the locking projection 136 such that the locking boss 136*a* has an outer diameter larger than the gap Da between the pair of elastic projections 118**.

When the locking boss **136*a* of the locking projection 136 elastically snaps into the gap Da between the pair of elastic projections 118 of the locking hole 116, an upper portion of the locking boss 136*a* is stopped by the lower edges of the pair of elastic projections 118, so that the locking projection 136 of the inner lid 130 is not unexpectedly removed from the gap Da of the locking opening 117 of the locking hole 116 before the user consciously opens the outer lid 130**.

In the present invention, the first airtight rubber seal 190, which fills the inner groove 180 of the upper surface 170 of the inner casing 110, is made of liquid rubber, such as room temperature vulcanizing (RTV) type silicon rubber.

Accordingly, when the RTV-type silicon rubber fills the inner groove 180 of the inner casing 110, the RTV-type silicon rubber is rapidly vulcanized in the room temperature to form the first airtight rubber seal 190, thus increasing productivity of the compact cosmetic case.

Figure 15:
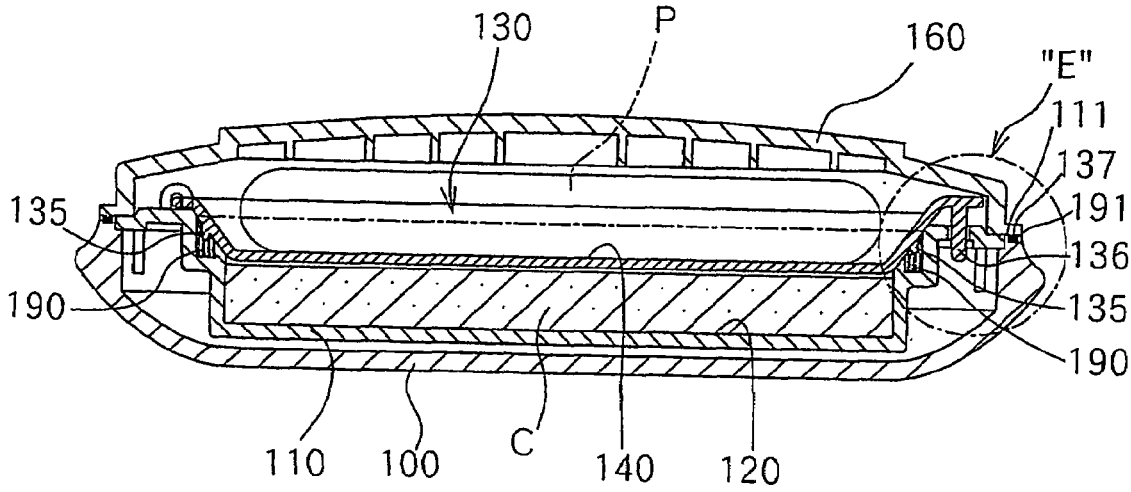
FIG. 15 is a sectional view of a compact cosmetic case with an airtight sealed structure, according to a fourth embodiment of the present invention.
Figure 16:
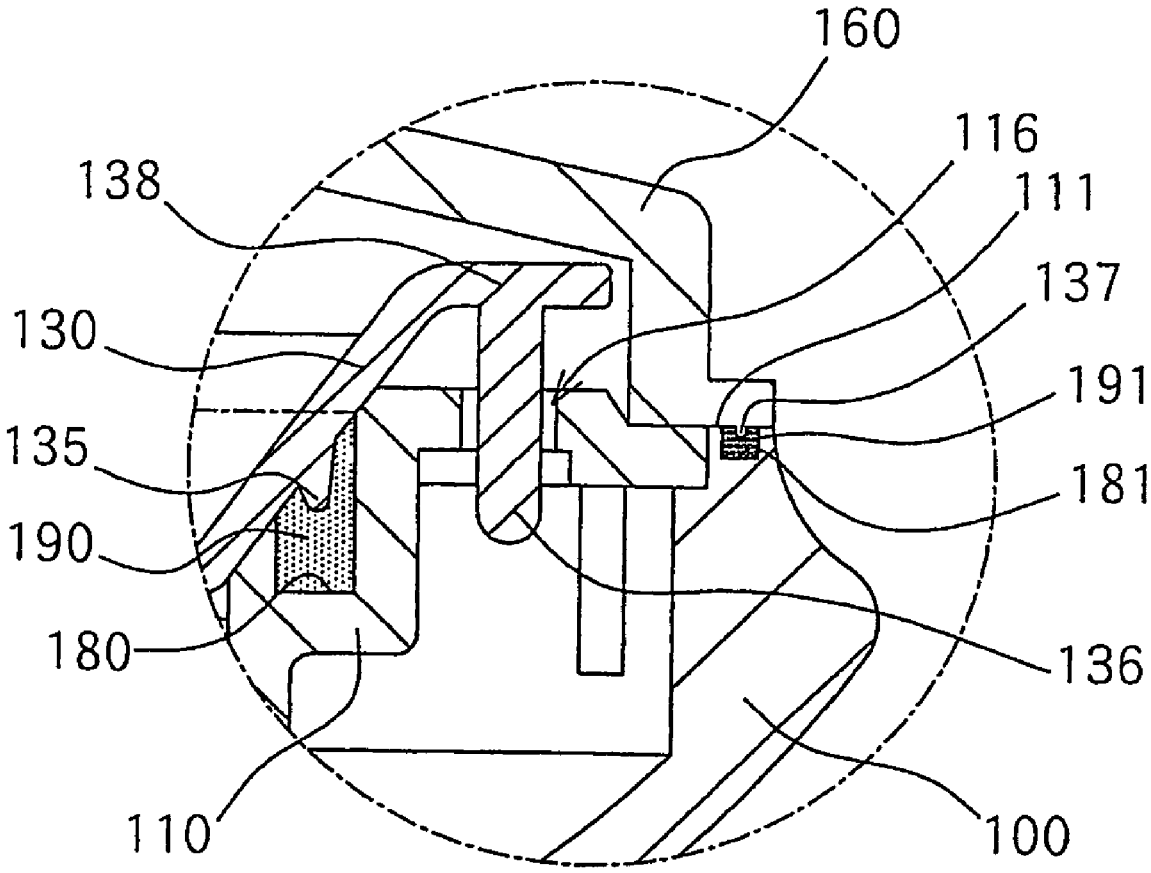
FIG. 16 is a partially enlarged sectional view of the compact cosmetic case shown by enlarging a portion H of the compact cosmetic case of FIG. 15.

FIG. 15 is a sectional view of the compact cosmetic case with an airtight sealed structure, according to a fourth embodiment of the present invention. FIG. 16 is a partially enlarged view of the compact cosmetic case shown by enlarging a portion H of the compact cosmetic case of FIG. 15.

As shown in FIGS. 15 and 16, the compact cosmetic case of the fourth embodiment of the present invention includes an outer groove 181 which is formed around an upper surface ill of the body 100, with the RTV-type silicon rubber which is a kind of liquid rubber filling the outer groove 181 and being vulcanized in the outer groove 181 to form a second airtight rubber seal 191. The compact cosmetic ease of the fourth embodiment of the present invention further includes an outer tip 137 which is formed around the lower surface of the outer lid 160 to be in contact with the second airtight rubber seal 191. Therefore, the compact cosmetic case prevents powder of the cosmetic C.M applied in a powder puff P placed in the powder puff 140 of the inner lid 130 from leaking through a gap between the upper surface 111 of the body 100 and the lower surface of the outer lid 160, while the outer lid 160 closes the body 100, thus accomplishing cleanliness of the compact cosmetic case.

Figure 17:
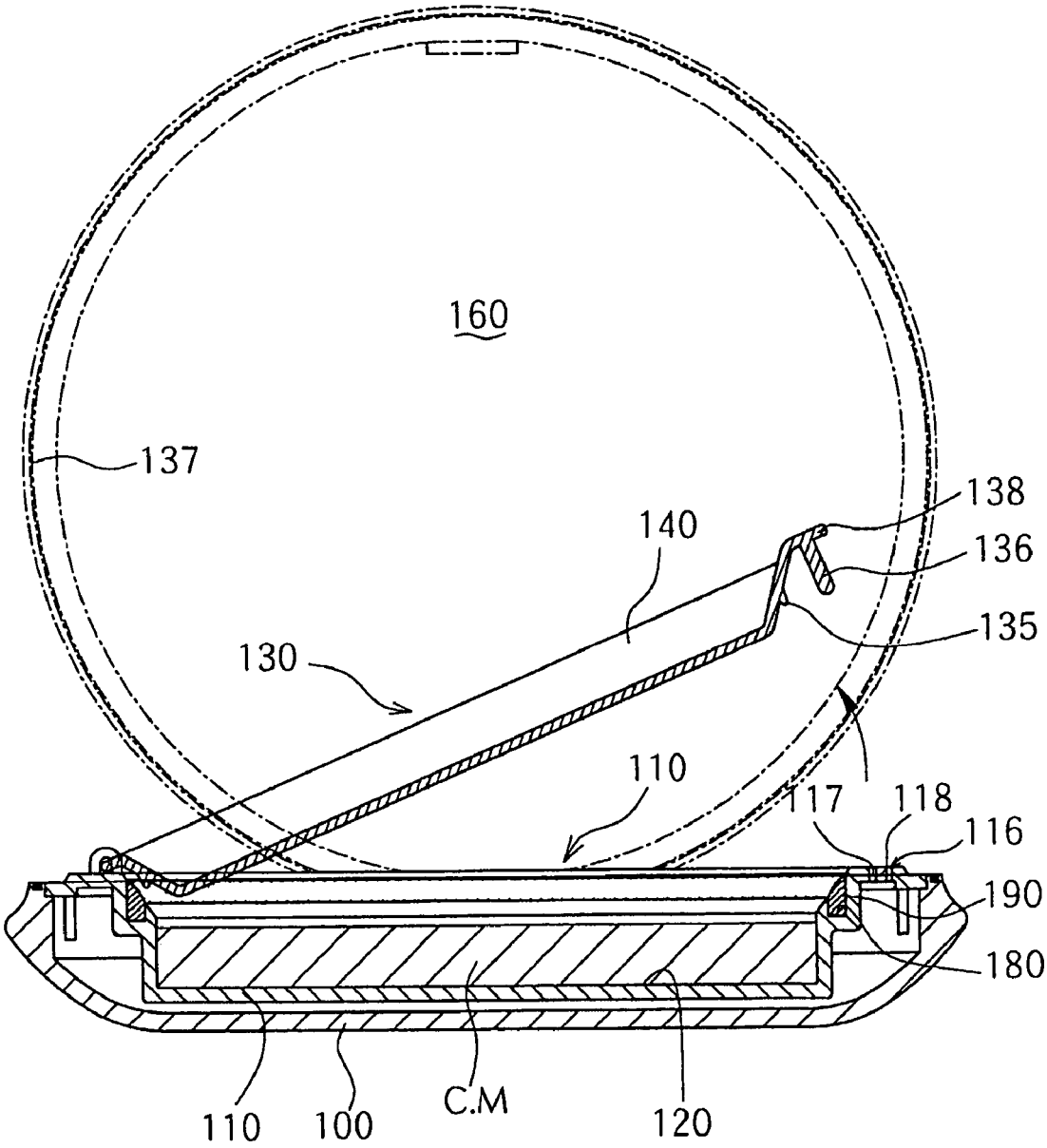
FIG. 17 is a sectional view showing an operation of the compact cosmetic ease of FIG. 15.

FIG. 17 is a sectional view showing an operation of the compact cosmetic case of FIG. 15.

As shown in FIG. 17, the compact cosmetic case of the fourth embodiment of the present invention accomplishes the desired airtight sealing effect of the inner casing 130 from the outside while the locking projection 136 of the inner lid 130 is locked into the locking hole 116 of the inner casing 110, without compressing the inner casing 130 by the weight of the powder puff P or having any additional outer projection 161 which is formed on the outer lid 160 to compress the inner casing 130, different from the compact cosmetic case of the first embodiment of the present invention. Therefore, even though the user losses the powder puff P or consciously removes the powder puff P to use the powder puff seat 140 without placing the powder puff P in the powder puff seat 140, the compact cosmetic case of the fourth embodiment of the present invention accomplishes the airtight sealing effect of the inner casing 130 from the outside. The above-mentioned operation and effect are obtained in the compact cosmetic case of the second and third embodiments of the present invention.

The compact cosmetic cases having the first and second airtight rubber seals 190 and 191 of the second, third and fourth embodiments of the present invention reliably maintain the moisture level and scent of the cosmetic C.M contained in the inner casing 110 without being changed for a long period of time by the enhanced airtight sealing effects of the compact cosmetic case from the outside. Furthermore, the compact cosmetic cases of the second, third and fourth embodiments of the present invention each prevent the powder of the cosmetic C.M applied in the powder puff P from leaking from the compact cosmetic case to the outside, thus accomplishing the cleanliness of the compact cosmetic case.

In particular, in the compact cosmetic cases of the second, third and fourth embodiments of the present invention, the RTV-type silicon rubbers fill the inner groove 180 of the inner casing 110 and the outer groove 181 of the body 100, and are rapidly vulcanized in the first and second grooves 180 and 181 to form the first and second airtight rubber seals 190 and 191. Therefore, the production processes of the compact cosmetic cases of the second, third and fourth embodiments of the present invention are simplified in comparison with the conventional compact cosmetic cases, thus reducing the production costs.

Furthermore, the compact cosmetic case of the present invention has a simple construction, different from the conventional compact cosmetic cases, and enhances the airtight sealing effect of the compact cosmetic case from the outside, thus increasing the productivity and reducing the number of defective products.

As described above, the present invention provides a compact cosmetic case with an airtight sealed structure, which has a simple construction and enhances its airtight sealed effect to prevent a leakage of cosmetics, such as powder, thus improving quality, increasing productivity and reducing the production costs and the number of defective products. In addition, when the compact cosmetic case of the present invention has two airtight rubber seals, the compact cosmetic case reliably maintains the moisture level and scent of a cosmetic contained in the case for a long period of time. Furthermore, even though a user losses a powder puff which is contained in an inner casing of the compact cosmetic case, the compact cosmetic case having the two airtight rubber seals accomplishes the desired airtight sealing effect.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A compact cosmetic case comprising:

a body having an inner casing therein, the inner casing defining a containing space to receive a cosmetic therein;

an inner lid hinged to the inner casing and having a powder puff seat, the inner lid formed of a transparent resin;

an outer lid to define a cover of the body, the outer lid hinged to the body at a first side thereof;

a locking unit provided on the compact cosmetic case at a position at a second side of the outer lid diametrically opposite to the first side so as to lock and unlock the outer lid to and from the body, so that the body is open and closed by the outer lid;

an inner groove formed around an upper surface of the inner casing, the inner groove having a rubber seal therein to seal a gap between the upper surface of the inner casing and the inner lid when the inner lid is in closed position;

a locking hole formed on the inner casing at a position corresponding to the second side of the outer lid diametrically opposite to the first side at which the outer lid is hinged to the body; and a locking lever having a locking projection and formed on the inner lid to be locked to the locking hole;

wherein the locking hole comprises a locking opening, with a pair of elastic projections projected inwardly from centers of both sides of the locking opening to form an H-shaped appearance of the locking opening.

2. The compact cosmetic case according to claim 1, further comprising an inner tip formed around an outside surface of the inner lid to be in contact with the rubber seal.

3. The compact cosmetic case according to claim 1, further comprising an outer projection formed on a lower surface of the outer lid to compress an upper surface of the inner lid.

4. The compact cosmetic case according to claim 1, wherein the locking projection of the locking lever has a diameter larger than a gap between the pair of the elastic projections of the locking hole and smaller than a width between opposite edges of the H-shaped locking opening.

5. The compact cosmetic case according to claim 1, wherein the locking projection of the locking lever has a diameter smaller than a gap between the pair of the elastic projections of the locking hole, with a locking boss formed around an end of the locking projection such that the locking boss has an outer diameter larger than the gap between the pair of elastic projections.

6. The compact cosmetic case according to claim 1, further comprising:

an outer groove formed around an upper surface of the body, the outer groove having a second rubber seal therein to seal a gap between the upper surface of the body and the outer lid when the outer lid is in closed position; and an outer tip formed around a lower surface of the outer lid to be in contact with the second rubber seal.

7. The compact cosmetic case according to claim 6, wherein each of the first and second rubber seals is made of room temperature vulcanizing (RTV) type silicon rubber which is a kind of liquid rubber.

8. The compact cosmetic case according to claim 1, wherein the inner lid is formed of a transparent resin.

9. A cosmetic case comprising:

a body defining an inner space;

an outer lid for covering the inner space of the body;

an inner casing disposed in the inner space of the body, the inner casing defining an inner containing space to receive a cosmetic therein, the inner casing having a flange portion with a locking hole formed in the flange portion, the locking hole having opposing disposed and inwardly extending elastic projections; and an inner lid hingedly covering the inner casing with a rubber seal engaged there-between to seal the inner containing space of the inner casing from outside, the inner lid having a first lateral side and a second lateral side diametrically opposite to the first lateral side, the first lateral side of the inner lid hinged to a first side of the inner casing, the second lateral side of the inner lid having a locking projection extending downwardly from the inner lid, the locking projection frictionally engaging with the elastic projections in the locking hole of the inner casing for closing the inner lid with respect to the inner casing.

10. The cosmetic case according to claim 9, wherein the locking hole and the elastic projections together have a generally H-shaped appearance.

11. The cosmetic case according to claim 10, wherein the locking projection of the inner lid has a diameter larger than a gap between the opposing elastic projections of the locking hole and smaller than a width between opposite edges of the generally H-shaped locking opening.

12. The cosmetic case according to claim 10, wherein the locking projection of the inner lid has a diameter smaller than a gap between the opposing elastic projections of the locking hole, with a locking boss formed on the locking projection such that the locking boss has an outer diameter larger than the gap between the opposing elastic projections.

* * * * *